US005601671A

United States Patent [19]

Speich

[11] Patent Number: 5,601,671

[45] Date of Patent: Feb. 11, 1997

[54] PROCESS AND INSTALLATION FOR THE MANUFACTURE OF NARROW FABRICS, IN PARTICULAR PATTERNED LABEL RIBBONS

[75] Inventor: Francisco Speich, Oberfrick, Switzerland

[73] Assignee: Textilma AG, Oberfrick, Switzerland

[21] Appl. No.: 30,180

[22] PCT Filed: Jun. 24, 1992

[86] PCT No.: PCT/CH92/00120

§ 371 Date: Jan. 28, 1994

§ 102(e) Date: Jan. 28, 1994

[87] PCT Pub. No.: WO93/02241

PCT Pub. Date: Feb. 4, 1993

[30] Foreign Application Priority Data

Jul. 18, 1991 [CH] Switzerland ..... 2143/91

[51] Int. Cl.[6] ..... D03D 47/50; D03J 1/06; D06H 7/00

[52] U.S. Cl. ..... 156/88; 156/148; 156/251; 156/259; 156/271; 156/308.4; 156/309.6; 156/515

[58] Field of Search ..... 156/88, 251, 259, 156/308.4, 308.2, 309.6, 271, 148, 515; 139/388, 389; 428/188, 121, 192

[56] References Cited

U.S. PATENT DOCUMENTS

| | | | |
|---|---|---|---|
| 2,200,882 | 5/1940 | Goldsmith | 139/389 X |
| 2,471,380 | 5/1949 | Wallwork | 139/389 |
| 3,155,121 | 11/1964 | Seltzer et al. | 139/389 X |
| 3,938,414 | 2/1976 | Rémond . | |
| 4,069,727 | 1/1978 | Sparks et al. | 156/88 X |
| 5,112,420 | 5/1992 | Dresner . | |
| 5,452,633 | 9/1995 | Speich | 83/16 |

FOREIGN PATENT DOCUMENTS

| | | |
|---|---|---|
| 0144119A3 | 6/1985 | European Pat. Off. . |
| 0389793A2 | 10/1990 | European Pat. Off. . |
| 0427933A1 | 5/1991 | European Pat. Off. . |
| 2340817A1 | 2/1975 | Germany . |
| 1230/70 | 9/1975 | Switzerland . |
| WO89/02491 | 3/1989 | WIPO . |
| 8902491 | 3/1989 | WIPO . |

*Primary Examiner*—Jeff H. Aftergut
*Attorney, Agent, or Firm*—Friedrich Kueffner

[57] ABSTRACT

A process and an apparatus for the manufacture of narrow fabrics include manufacturing a wide fabric run with hollow fabric areas extending along predefined cutting lines, wherein each hollow fabric area is manufactured by providing a front fabric portion and a rear fabric portion, and wherein the edges of the front and rear fabric portions are connected to each other to form a hollow space. The fabric run is cut along the cutting lines such that the front and rear fabric portions are not connected to one another.

22 Claims, 3 Drawing Sheets

Figure 1:
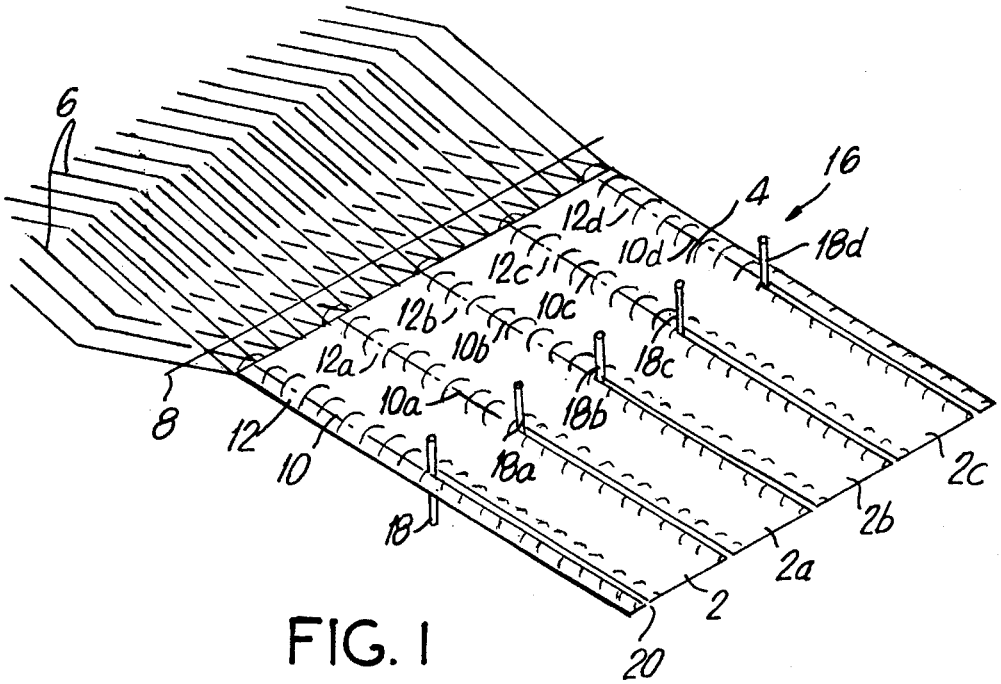

PROCESS AND INSTALLATION FOR THE MANUFACTURE OF NARROW FABRICS, IN PARTICULAR PATTERNED LABEL RIBBONS

The invention relates to a process for the manufacture of fabric ribbons, in particular patterned label ribbons wherein individual ribbons are cut out of a wide fabric run containing hollow fabric areas along pre-defined cutting lines as well as to an installation for conducting the process according to the part of claim 15 describing the background art.

Processes and installations of the type mentioned above are known from several sources, e.g. from EP-OS 0 389793. With these known processes and the corresponding installation the meltable fabric run is cut thermally by means of a cutting element in the form of a cutting wire. The melted mass resulting from the cutting operation at the cut produces a relatively hard and rough bead which impairs the appearance and the handling of the cut fabrics. In EP-OS 0 389 793 the attempt is made to avoid these disadvantages in that the edge areas of the fabrics with the melted selvedges are folded over along folding lines parallel to the selvedge which are located in a hollow area of the fabric, thereby forming folding legs, whereupon the folding legs are glued to the adjoining surface zones of the associated fabric strip. For this purpose the parts, which are positioned one above the other, are hot-pressed, whereby the inlaid melting thread melts and produces the fixation. Of disadvantage in this instance is the fact that the edge area is relatively thick because it is formed by a folded hollow area of the fabric run, i.e. in the selvedge area four parts of the fabric run are located on top of one another.

The objective of the invention is to devise a process and an apparatus for the manufacture of narrow fabrics, in particular of patterned label fabrics, such that the aforementioned disadvantages are avoided.

In accordance with the present invention, the process includes manufacturing the fabric run with hollow fabric areas, wherein the hollow fabric areas are arranged along the cutting lines, and cutting the fabric run along the cutting lines, such that front parts and rear parts of the hollow fabric areas are not connected with one another.

Due to the fact that the hollow fabric areas of the fabric run are arranged along the cutting lines, and that the cutting of the fabric run takes place along the cutting lines and hence along the hollow fabric areas such that the front parts, e.g. the ground fabric parts, and the rear parts e.g. the figure fabric parts of the hollow fabric areas, are not connected with one another, a soft thin cutting area ensues on the fabric selvedges. In the case of patterned woven fabric runs the figure fabric part in the hollow fabric area can be arranged on the back such that ground fabrics located at the front are not impaired by the cut. The cut ground fabric part is characterized by a homogeneity in the colors of its ground fabric, i.e. without mixture with the colors of the figure pick. A fabric of high quality is obtained.

The cutting areas can be improved by shortening of the rear part of the cut hollow fabric area so that, the cut selvedge becomes softer on the rear of the fabric, due to which it is scarcely visible from the front, i.e. from the exterior side of the fabric. The fabric has a homogeneous and attractive appearance. A part of the hollow fabric area can easiest be shortened by means of a cutting tool which is inclined perpendicularly to the cutting line. The part of the hollow area can be shortened more when the part to be shortened is erected perpendicularly to the plane of the ribbon and is shortened by means of an additional cutting tool.

The quality, in particular the fineness of the cut area of the fabrics, can be improved further by folding of the rear part of the rear part of the cut hollow fabric area toward the center of the ribbon and gluing the rear part to the part of the ribbon located underneath. In this embodiment the gluing can be done by the application of an adhesive to the part of the hollow area to be fastened. More advantageous is an embodiment in which a fabric run is manufactured which contains melting and/or adhesive threads at least in the hollow fabric area. In particular through subsequent application of an adhesive, or through manufacture of the fabric run with weft threads arranged at least in the hollow fabric area which melt as a whole on the application of heat and/or pressure, and/or of adhesive threads with which a ground material is provided with an adhesive coating that is activated on the application of heat and/or pressure, it is possible to manufacture fabric runs from non-thermoplastic material. In this context the adhesive and/or the melting and/or adhesive threads serve to solidify the cut selvedges and/or to fasten a folded-over par of the hollow fabric area to the part of the fabric located.

In accordance with an especially advantageous embodiment of the present invention, a fabric run is manufactured of thermoplastic threads which in the hollow fabric areas contains additional melting and/or adhesive threads, wherein the melting temperature of the threads is lower than that of the other threads. In this case the thermoplastic threads of the fabric run permit solidification of the cutting area by the very thermal cutting. Due to the fact that the cut is made in the hollow area, the individual parts of the fabric run are thinner, and resultant beads are also smaller and finer so that they are scarcely troublesome. In particular, with a patterned fabric the colors of the ground fabric run are also scarcely impaired because no or only extremely slight mixing of colors occurs so that it is visually almost imperceivable. Hence, a supple cutting area on the ribbons ensues. Such ribbons are characterized by high-grade quality and are nearly equivalent to fabrics with woven or knitted selvedges. With fabric runs of thermoplastic threads the quality of the ribbons can be improved further by the measures already discussed above.

The fabric run can be cut by means of a mechanical cutting device which can be used on textile materials of non-synthetic as well as of synthetic, i.e. thermoplastic threads. In the latter case, however, cutting by means of a thermal cutting device is of greater advantage because an initial or lasting solidification of the cut threads against fraying is obtained.

In accordance with another advantageous embodiment, the fixing of the cutting areas and/or connection of cut parts of the hollow fabric areas is accomplished by heating and pressing parts of the fabric run with thermoplastic threads.

Moreover, the cutting areas of the fabrics can be subjected to a forming process and/or a concluding thermofixing process to render the fabrics stress-free.

The individual steps of the process such as:

manufacture of the fabric run cutting of the fabric run into ribbons and fixing of the cutting areas forming of the cutting areas thermofixing of the ribbons.

can be performed one at a time. It is of special advantage, however, for the individual steps of the process to be conducted continuously in a single work operation.

Generally, it is possible to manufacture and to use different types of fabric runs, for example a fabric run of fiber vlies. Of particular advantage is however the manufacture of a knitted and especially a woven fabric run. In this case such a fabric run can be patterned.

Figure 2:
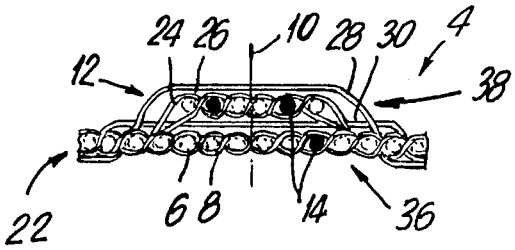
Figure 3:
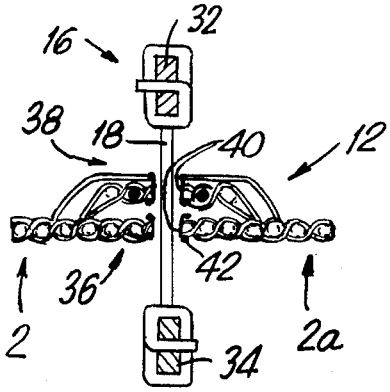
Figure 4:
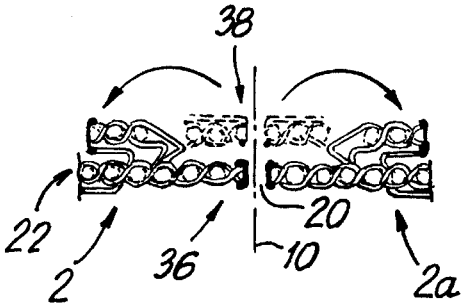
Figure 5:
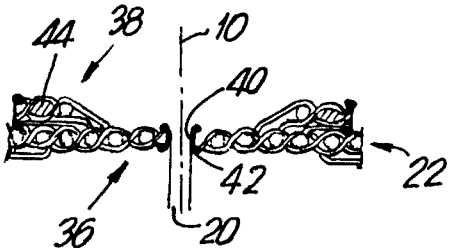
Figure 6:
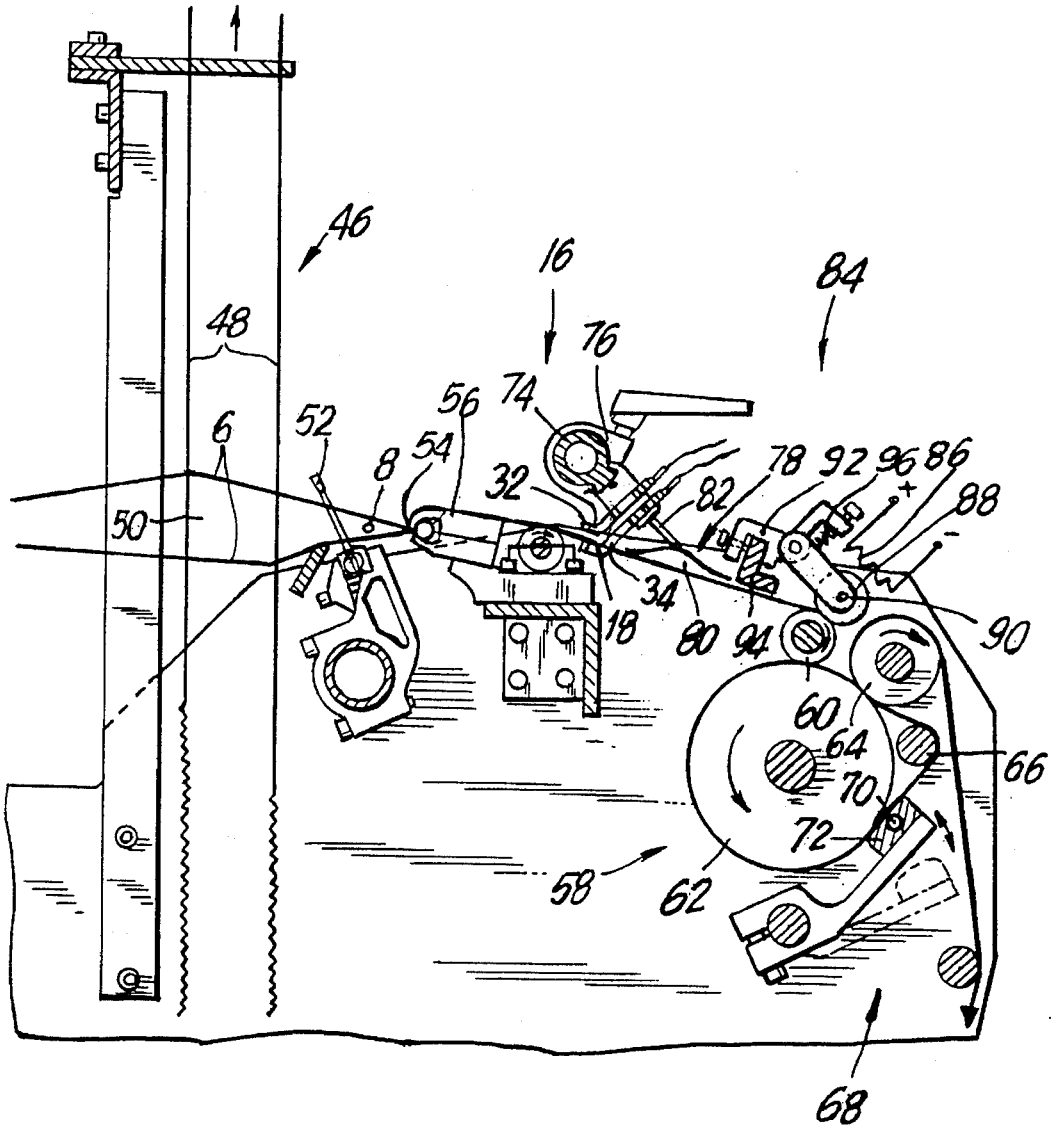
Figure 7:
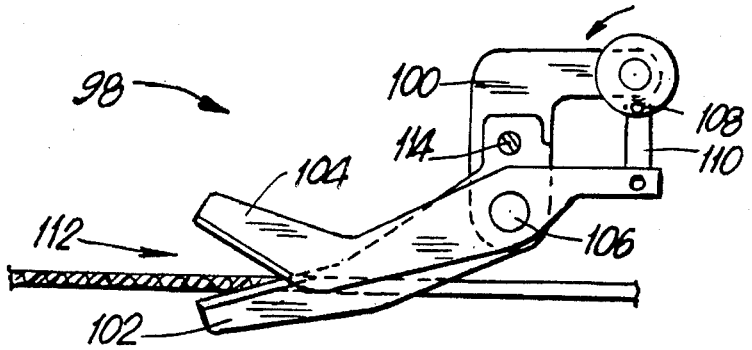
Figure 8:
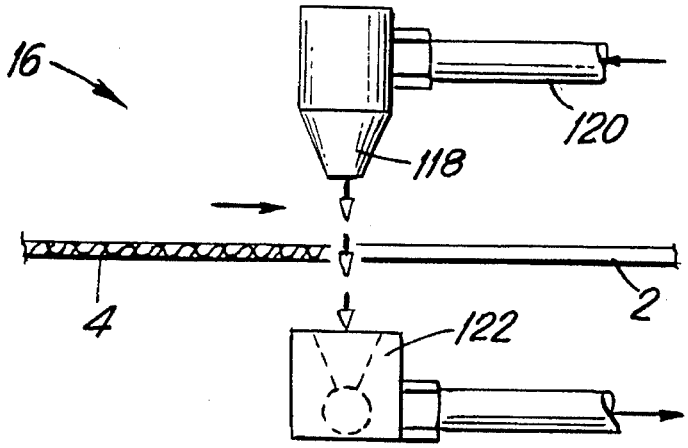
Figure 9:
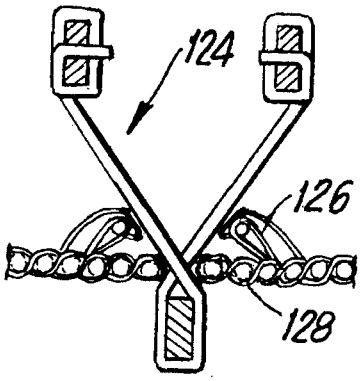
Figure 10:
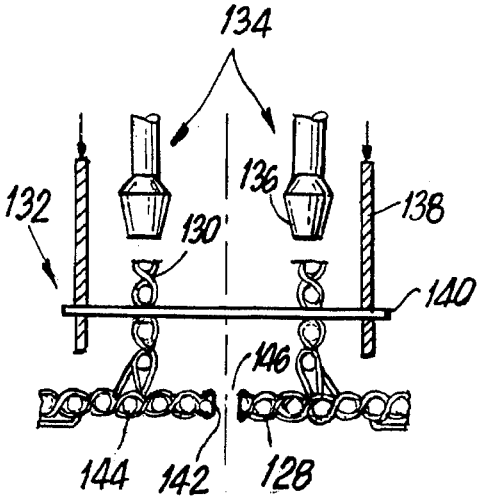
Figure 11:
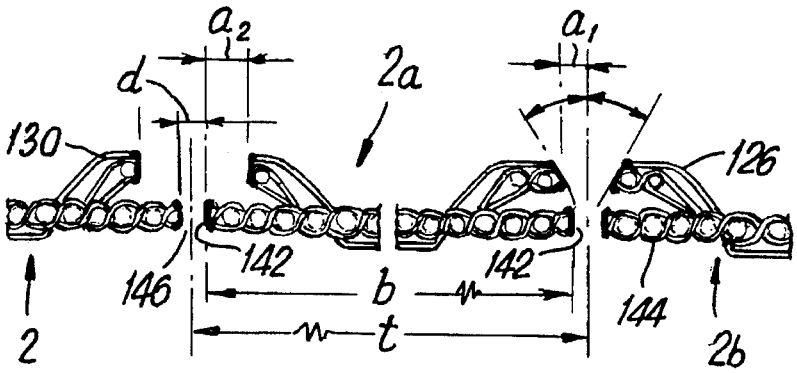

Examples of embodiments of the object of the invention are described in detail on the basis of schematic drawings. Shown are:

FIG. 1 a diagram for the manufacture of narrow fabrics from a woven fabric run in perspective view;

FIG. 2 a hollow fabric area oil a fabric run, in cross-sectional view;

FIG. 3 the hollow fabric area of FIG. 2 on thermal cutting, in cross-sectional view;

FIG. 4 the cut hollow fabric area of FIG. 3 with the rear part of the hollow fabric area folded over, in cross-sectional view;

FIG. 5 the finished cut area of a narrow fabric, in cross-sectional view; FIG. 6 an apparatus for the manufacture of narrow fabrics, in vertical cross-sectional view;

FIG. 7 a mechanical cutting device, in side elevation view;

FIG. 8 another thermal cutting device, in side elevation view;

FIG. 9 a fabric run being cut with a V-shaped cutting element, in cross-sectional view;

FIG. 10 a cut fabric run, the rear part of a hollow fabric area of which is being shortened in, partial cross-sectional view;

FIG. 11 a cut textile cloth fabric in partial cross-sectional view.

FIG. 1 shows schematically the manufacture of fabrics 2, 2*a*, 2*b*, 2*c* from a fabric run 4. The fabric run in this example is a woven fabric run, the construction of which is shown in detail in FIGS. 2 to 5. The fabric run 4 consists of warp threads 6 and woven-in weft threads 8. The fabric is manufactured such that hollow fabric areas 12, 12*a*, 12*b*, 12*c*, 12*d* are formed along the cutting lines 10, 10*a*, 10*b*, 10*c*, 10*d* that are furnished with melting threads 14. The hollow fabric areas 12, 12*a*, 12*b*, 12*c*, 12*d* are formed by providing a lower or front fabric portion and an upper or rear fabric portion fabric portion, wherein the edges of the fabric portions are connected to each other to form a hollow space. The fabric run manufactured in this manner is fed to a cutting device 16 equipped with cutting elements 18, 18*a*, 18*b*, 18*c*, 18*d* which consist e.g. of heated cutting wires, and which cut the fabric run 4 along the cutting lines 10, 10*a*, 10*b*, 10*c*, 10*b* such that the individual fabrics 2, 2*a*, 2*b*, 2*c* are separated from one another by cutting lanes 20. The construction of the woven fabric run 4 can be as shown, for example, by FIG. 2, warp threads 6 being held together by weft threads 8 and forming a ground fabric 22. A hollow fabric area 12 is formed by weft threads 24 and warp thread 26 extending on the rear side of the ground fabric 22. The hollow fabric area can be interspersed with additional melting threads 14. In addition, the fabric run 4 shown in part view contains pattern weft threads 28, 30 extending floating on the rear of the fabric run which in part extend loosely through the hollow fabric area 12 and in part above the hollow fabric area 12.

FIG. 3 shows the thermal cutting of the fabric run by means of a cutting element 18 which is clamped in supporting arms 32, 34. The melt cutting proceeds such that the front part 36 of the hollow fabric which is allocated to the ground fabric 22 is not connected with the rear part 38 by the melt cutting. The melt cutting produces narrow cut surfaces 40 with just as narrow beads 42 formed from the melt. After the cutting, as shown in FIG. 4 the rear parts 38 of the cut hollow fabric areas are folded over toward the center of the associated fabric 2, 2*a* and connected with the part of the fabric lying underneath, i.e. the ground fabric, by hot-pressing as shown in FIG. 5. As a result of the hot- pressing the melting threads 14 melt and form a melted mass 44 which diffuses into the adjoining threads, thereby connecting them together.

FIG. 6 shows an installation for conducting the manufacturing process for fabrics 2, 2*a*, 2*b*, 2*c* indicated in FIG. 1. The apparatus contains a weaving area 46 with warp threads 6 guided by heddles, 48 as well as melting threads, by means of which process a shed 50 is formed into which weft thread 8 is inserted and beat up to a beat-up edge by a reed 52. The weaving machine is controlled in a known manner such that hollow areas are produced in the fabric run along the defined cutting lines. A fabric hold-down device 56 serves to guide the woven fabric run 4 to a thermal cutting device 16, by means of which the fabric run 4 is cut into ribbons 2 which are taken off by a fabric take-off device 58 and a fabric beam not shown. The fabric take-off device 58 contains a first deflector roll 60, a take-off roll 62, as well as further deflector rolls 64, 66. It is additionally equipped with a thermofixing device 68. The latter contains a pad 72 which is heated by a heater 70.

On a support 74 overreaching the fabric run 4 the cutting device 16 is equipped with brackets 76 holding carrying arms 32, 34 that support the cutting element 18 on their front end area which is pointed in the direction of travel of the fabric run. Following the cutting device 16 is a folding device 78 which folds the rear part 38 of the cut fabric run toward the middle of the associated fabric: in accordance with the process step of FIG. 4. The individual folding elements 80 of the folding device 78 are connected with the support 76 of the cutting device 16 by means of arms 82.

The cut fabrics which are pre-treated in this manner are now fed to a hot pressing device 84 which is equipped with pressing rolls 88 for each cutting area that are heated by a heater 86. The pressing rolls 88 interacting with the deflector roll 60 of the fabric take-off device 58 are supported on pivoted arms 90 which are connected via a joint with bracket 92, which in turn is fastened to a support 94 overreaching the cut fabrics. A spring 96 serves to pre-stress the pressing rolls 88 against the deflector roll 60. By means of this hot pressing device 84 the rear parts 38 of the hollow fabric areas 12 can be connected with the associated other parts of the fabric as is shown in FIG. 5.

FIG. 7 shows a mechanical cutting device 98 with a stationary shearing blade 102 fastened to a bracket 100 and a movable shearing blade 104. The latter is movably mounted on a shaft 106 and is driven via a driven cam 108 and a coupling link 110. The mechanical cutting device 98 has such a cutting tool 112, consisting of the shear blades 102, 104 for each cutting line. The individual cutting tools are arranged on a support 114 overreaching the fabrics.

FIG. 8 shows a further thermal cutting device 116 which is equipped with a nozzle 118 for each cutting line to which a hot medium is supplied via a line 120 that is blown through the fabric run 4 toward an intake funnel 122, as a result of which the thermoplastic fabric run 4 is cut into ribbons 2.

FIG. 9 shows the cutting of the fabric run 4 by means of a V-shaped cutting element 124. This process produces a V-shaped cut, having the effect that the rear parts 126 of the hollow area 12 is shortened relative to the front part 128 formed by the ground fabric, that it is retracted toward the middle of the ribbon.

FIG. 10 shows a further example of an embodiment of the present invention for shortening the rear part 130 of the cut hollow fabric area 12 of a fabric run 4. For this purpose the cutting device 132 contains a device 134 for erecting the rear part 130 of the hollow fabric area 12, for which purpose this erecting device 134 is equipped with suction nozzles 136 which are allocated to the rear parts 130 of the cut hollow fabric area. The cutting device 132 also contains a cutting element 1140 in the form of a resistance heating wire held by supports 138. The rear parts 130 of the hollow fabric area 12 can be shortened correspondingly with the cutting device.

FIG. 11 shows a fabric run cut into ribbons 2, 2*a*, 2*b*, the rear parts 126 of the hollow fabric areas 12 being cut e.g. according to FIG. 9 and the rear parts 130 being shortened as per the device according to FIG. 10. As a result the rear pads 126, 130 are set back from the cut surface 142 of the ground fabric by the distances $a_1$ and $a_2$ respectively. FIG. 11 also shows that the individual ribbons 2, 2*a*, 2*b* on the exterior side 144 have a useful width b which is reduced by the width d of the cutting lane 146 related to the cutting pitch t.

Many other examples of embodiments of the present invention are possible. It is in particular possible to use fabric runs of non-synthetic material, in which case e.g. it is expedient to supplement the folding device shown in FIG. 6 with a device for applying an adhesive between the rear part of the ribbon and the ground fabric of a ribbon. The adhesive can then be distributed or hardened on the hot pressing device 84, thereby also enabling non-synthetic textile materials to be cut and provided with cut areas resistant to fraying.

I claim:

1. A process for the manufacture of narrow fabrics, the process comprising manufacturing a wide fabric run with hollow fabric areas extending along predefined cutting lines, each hollow fabric area being manufactured by providing a front fabric portion and a rear fabric portion, the front fabric portion and the rear fabric portion having edges, wherein the edges of the front and rear fabric portions are connected to each other to form a hollow space, cutting the fabric run along the cutting lines such that the front and rear fabric portions are not connected to one another, and laterally shortening the rear fabric portions of the cut hollow fabric areas relative to the front fabric portions.

2. The process according to claim 1, comprising shortening each rear fabric portion by means of a cutting tool which is inclined perpendicularly relative to the cutting line.

3. The process according to claim 1, comprising erecting the rear fabric portion to be cut perpendicularly relative to a plane of the fabric run and shortening the rear fabric portion by means of an additional cutting tool.

4. The process according to claim 1, comprising folding over each rear fabric portion after cutting toward a center of each narrow fabric, and connecting each folded-over rear fabric portion to the adjacent fabric run.

5. The process according to claim 1, comprising manufacturing a fabric run which contains at least one of melting threads and adhesive threads at least in the hollow fabric areas.

6. The process according to claim 1, comprising manufacturing a fabric run of thermoplastic threads, and manufacturing the hollow fabric areas with at least one of additional melting threads and adhesive threads, wherein the additional threads have a melting temperature which is lower than a melting temperature of the thermoplastic threads.

7. The process according to claim 1, comprising cutting the fabric run by means of a mechanical cutting device.

8. The process according to claim 1, comprising cutting the fabric run by means of a thermal cutting device comprising a hot cutting element.

9. The process according to claim 1, comprising fixing of cutting areas and connecting cut parts of the hollow fabric areas by heating and pressing parts of the fabric run having thermoplastic threads.

10. The process according to claim 1, comprising thermofixing the narrow fabrics as a final step of the process.

11. The process according to claim 1, comprising carrying out individual process steps continuously in a single work operation.

12. The process according to claim 1, comprising manufacturing a knitted or woven fabric run.

13. The process according to claim 1, comprising manufacturing a patterned knitted or woven fabric run having floating designs with threads on the rear of the fabric run extending freely at least one of through and over the hollow fabric areas.

14. An apparatus for manufacturing narrow fabrics, the apparatus comprising a device for manufacturing a wide fabric run with hollow fabric areas extending along predefined cutting lines, each hollow fabric area having a front fabric portion and rear fabric portion, each fabric portion having edges, wherein the edges of the front and rear fabric portions are connected to each other to form a hollow space, and a cutting device for cutting the fabric run along the cutting lines into single narrow fabrics such that the front and rear fabric portions are not connected to one another and the rear fabric portion is shorter than the front fabric portion.

15. The apparatus according to claim 14, wherein the cutting device comprises mechanical cutting means with cutting tools for each cutting line.

16. The apparatus according to claim 14, wherein the cutting device comprises thermal cutting means with cutting elements for each cutting line.

17. The apparatus according to claim 14, further comprising a device for erecting cut parts of the hollow fabric areas perpendicular to a plane of the cut narrow fabric, and an additional cutting device for shortening the erected cut parts of the hollow fabric areas.

18. The apparatus according to claim 14, comprising a device for folding over cut parts of the hollow fabric areas toward a center of each narrow fabric.

19. The apparatus according to claim 14, comprising a hot pressing device for the cut hollow fabric areas.

20. The apparatus according to claim 14, comprising forming devices for cut edges of the narrow fabric.

21. The apparatus according to claim 14, comprising a thermofixing device for the narrow fabrics.

22. The apparatus according to claim 14, wherein the apparatus is constructed in the form of a loom.

* * * * *